US007670739B2

(12) United States Patent
Lin et al.

(10) Patent No.: US 7,670,739 B2
(45) **Date of Patent: *Mar. 2, 2010**

(54) SINGLE LAYERED PHOTOCONDUCTORS

(75) Inventors: Liang-Bih Lin, Rochester, NY (US); Daniel V. Levy, Rochester, NY (US); Jin Wu, Webster, NY (US); Linda L. Ferrarese, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 360 days.

This patent is subject to a terminal disclaimer.

(21) Appl. No.: 11/796,931

(22) Filed: Apr. 30, 2007

(65) Prior Publication Data

US 2008/0268359 A1 Oct. 30, 2008

(51) Int. Cl.
*G03G 5/04* (2006.01)

(52) U.S. Cl. ..... 430/59.5; 430/69; 399/162

(58) Field of Classification Search ..... 430/69, 430/84, 88, 59.5; 399/162
See application file for complete search history.

(56) References Cited

U.S. PATENT DOCUMENTS 4,251,615 A * 2/1981 Rosenthal ..... 430/89
4,265,990 A 5/1981 Stolka et al.
4,298,697 A 11/1981 Baczek et al.
4,338,390 A 7/1982 Lu
4,560,635 A 12/1985 Hoffend et al.
6,156,468 A 12/2000 Wehelie et al.
6,177,219 B1 1/2001 Yuh et al.
6,218,062 B1 4/2001 Yuh et al.
6,255,027 B1 7/2001 Wehelie et al.
6,913,863 B2 7/2005 Wu et al.
7,037,631 B2 5/2006 Wu et al.
2007/0048639 A1 * 3/2007 Wu et al. ..... 430/60

FOREIGN PATENT DOCUMENTS

JP 07168381 * 7/1995

OTHER PUBLICATIONS

English language machine translation of JP 07-168381.*

* cited by examiner

*Primary Examiner*—John L Goodrow
(74) *Attorney, Agent, or Firm*—E. O. Palazzo

(57) ABSTRACT

A photoconductor that includes a supporting substrate, and an active layer in contact with the substrate, and which layer contains at least one photogenerating pigment, at least one charge transport component, and a mixture of a metal oxide and a chelating agent of a tetrafluorodihydroxyanthraquinone.

29 Claims, No Drawings

SINGLE LAYERED PHOTOCONDUCTORS

CROSS REFERENCE TO RELATED APPLICATIONS

Illustrated in copending U.S. application Ser. No. 11/796,933, U.S. Publication No. 20080268360, filed Apr. 30, 2007, the disclosure of which is totally incorporated herein by reference, is a member comprised of a supporting substrate, and a layer in contact with the substrate, and which layer is comprised of a hydroxygallium phthalocyanine pigment, at least one charge transport component, and a metal oxide having attached thereto a chelating agent of a tetrafluorodihydroxy anthraquinone, and wherein the phthalocyanine is prepared by hydrolyzing a gallium phthalocyanine halide.

Illustrated in copending U.S. application Ser. No. 11/796,900, U.S. Publication No. 20080268358, filed Apr. 30, 2007, the disclosure of which is totally incorporated herein by reference, is a member comprised of a supporting substrate, and a layer in contact with the substrate, and which layer is comprised of a titanyl phthalocyanine pigment, at least one charge transport component, and a metal oxide having attached thereto a chelating agent of a tetrafluorodihydroxy anthraquinone, and wherein the titanyl phthalocyanine is prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene.

BACKGROUND

This disclosure is generally directed to imaging members, photoreceptors, photoconductors, and the like. More specifically, the present disclosure is directed to single layered flexible, belt imaging members, or devices comprised of an optional supporting medium like a substrate, and thereover a single layer comprised of a photogenerating pigment or pigments, a charge transport component or components, and a metal oxide having applied thereto a chelating agent of, for example, an anthraquinone like a tetrafluorodihydroxyanthraquinone, an optional adhesive layer, an optional hole blocking or undercoat layer, and an optional overcoating layer. The photoreceptors illustrated herein, in embodiments, have excellent charge acceptance characteristics, and wherein charge leakage is minimized and in some embodiments substantially eliminated. Also, in embodiments a photoconductor with the single layered active layer deposited on a supporting substrate possesses excellent wear resistance, extended lifetimes, elimination or minimization of imaging member scratches on the surface of the member, and which scratches can result in undesirable print failures where, for example, the scratches are visible on the final prints generated. Additionally, in embodiments the imaging members disclosed herein possess excellent, and in a number of instances low $V_r$ (residual potential), and allow the substantial prevention of $V_r$ cycle up when appropriate; high sensitivity; low acceptable image ghosting characteristics; low background and/or minimal charge deficient spots (CDS); and desirable toner cleanability.

Also included within the scope of the present disclosure are methods of imaging and printing with the photoconductors, which can be negatively charged, as illustrated herein. These methods generally involve the formation of an electrostatic latent image on the photoconductor, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components such as the supporting substrates, the photogenerating pigments, the charge transport compounds, the resin binders, and the like may be selected for the present disclosure in embodiments thereof.

SUMMARY

Disclosed are imaging members with many of the advantages illustrated herein, such as extended lifetimes of service of, for example, about 2,500,000 imaging cycles; improved charge acceptance characteristics as compared, for example, to a similar member that is free of a metal oxide treated mixture as disclosed herein; excellent electronic characteristics; stable electrical properties; low image ghosting; low background and/or minimal charge deficient spots (CDS); resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photo-Induced Discharge Curve), and the like.

Also disclosed are photoresponsive imaging members which are responsive to near infrared radiation of from about 700 to about 900 nanometers.

Further disclosed are layered flexible photoresponsive imaging members with sensitivity to visible light.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$ where the imaging members exhibit low background and/or minimal CDS; and the prevention of $V_r$ cycle up caused primarily by photoconductor aging for numerous imaging cycles

EMBODIMENTS

Aspects of the present disclosure relate to an imaging member comprising a supporting substrate, and thereover a layer comprised of a photogenerating component and a charge transport component, optionally dispersed in a suitable polymer binder and a metal oxide treated with a chelating agent of, for example, a tetrafluorodihydroxyanthraquinone; a photoconductive member with an active layer thickness of from about 1 to about 25, from 1 to about 20, from 1 to about 10 microns; a xerographic imaging apparatus containing a charging component, a development component, a transfer component, and a fixing component, and wherein the apparatus contains a single layered photoconductive imaging member as illustrated herein; a photoconductor wherein the treated metal oxide is present in an amount of from about 0.1 to about 30 weight percent, or from about 1 to about 10 weight percent; a member wherein the active single layer contains a photogenerating pigment present in an amount of from about 10 to about 95 weight percent; a member wherein the active single layer contains an inactive polymer binder; a member wherein the binder is present in an amount of from about 50 to about 90 percent by weight, and wherein the total of all layer components is about 100 percent; a member wherein the active layer photogenerating pigment is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the resinous binder is selected from the group consisting of known suitable polymers like polyesters, polyvinyl butyrals, polycarbonates, polystyrene-b-polyvinyl pyridine, and polyvinyl formals; an imaging member wherein the active single layer photogenerating pigment is a metal free phthalocyanine; an imaging member or photoconductor wherein the single layer charge transport compound comprises

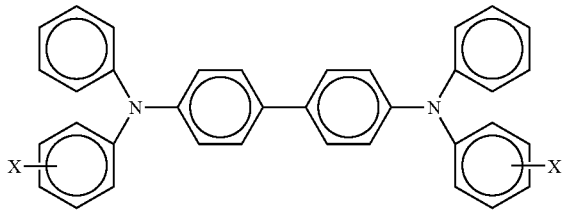

wherein X is selected from the group consisting of alkyl, alkoxy, and halogen, such as methyl and chloride; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein the single layer charge transport compound comprises

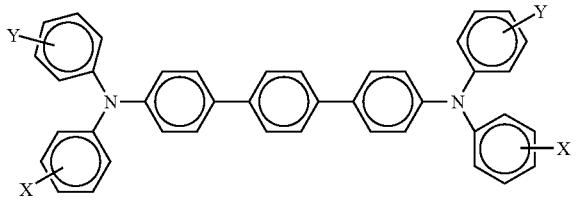

wherein X and Y are independently alkyl, alkoxy, aryl, a halogen, or mixtures thereof wherein, for example, alkyl and alkoxy contain from about 1 to about 15 carbon atoms; alkyl contains from about 1 to about 5 carbon atoms; and wherein the resinous binder is selected from the group consisting of polycarbonates and polystyrene; a photoconductor wherein the single layer includes chlorogallium phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2Θ±0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the single layer is of a thickness of from about 5 to about 25 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the active layer is from about 1 to about 11 microns; a member wherein the photogenerating and charge transport components are contained in a polymer binder; a member wherein the binder is present in an amount of from about 50 to about 90 percent by weight, and wherein the total of the layer components is about 100 percent, and wherein the photogenerating resinous binder is selected from the group consisting of polyesters, polyvinyl butyrals, polycarbonates, polystyrene-b-polyvinyl pyridine, and polyvinyl formals; an imaging member wherein the photogenerating component is Type V hydroxygallium phthalocyanine, or chlorogallium phthalocyanine, and the charge transport compound is a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the resinous binder is selected from the group consisting of polycarbonates and polystyrene; a photoconductive imaging member with a blocking layer contained as a coating on a substrate, and an adhesive layer coated on the blocking layer; a color method of imaging which comprises generating an electrostatic latent image on the imaging member, developing the latent image, transferring, and fixing the developed electrostatic image to a suitable substrate; and a single layer contained on a supporting substrate, and which layer comprises a mixture of a photogenerating pigment, a hole transport compound, a resin binder, and a metal oxide having attached thereto a chelating agent of a tetrafluorodihydroxyanthraquinone; a member comprised of a supporting substrate, and a layer in contact with the substrate, and which layer is comprised of at least one photogenerating pigment, at least one charge transport component, and a metal oxide having attached thereto a chelating agent of a tetrafluorodihydroxy anthraquinone; a photoconductor comprising a supporting substrate, and an active layer in contact with the substrate, and which layer is comprised of at least one photogenerating pigment, at least one charge transport component, and a mixture of a metal oxide and a chelating agent of a tetrafluorodihydroxy anthraquinone; and a negatively charging photoconductor comprised of at least one photogenerating pigment, at least one charge transport component, at least one polymer binder, and a mixture of a metal oxide and a chelating agent of an anthraquinone.

Examples of chelating compounds can be represented, for example, by

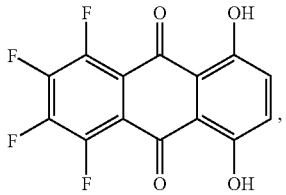

and more specifically, wherein the chelating compound is 1,2,3,4-tetrafluoro-5,8-dihydroxyanthraquinone (TFQ). Examples of chelating agents include quinones, such as quinizarin, alizarin, amides, such as carboxamides (—$CONH_2$) and sulfonamides (—$SO_2NH_2$); examples of carboxamides include lactamide, glycolamide, succinamide, oxamide, formamide, acetamide, behenamide, 2,2-diethoxyacetamide, acrylamide, benzamide, glucuronamide, isonicotinamide, niacinamide, pyrazinecarboxamide, diamide, and examples of sulfonamides include 5-(dimethylamino)-1-naphthalenesulfonamide, cyclopropanesulfonamide; a number of other suitable known chelating agents include β-diketones such as acetyl acetone and 2,4-heptanedione, ketoesters such as methyl acetoacetate, ethyl acetoacetate, propyl acetoacetate and butyl acetoacetate, hydroxyl carboxylic acids such as butyric acid, salicylic acid and maleic acid, hydroxyl carboxylic acid esters such as methyl lactate, ethyl salicylate and ethyl maleate, keto alcohols such as 4-hydroxy-4-methyl-2-pentanone, amino alcohols such as triethanolamine, and mixtures thereof, and more specifically, β-hydroxyketone or β-diketone containing substances, especially small molecule β-hydroxyketones or β-diketones such as 4-hydroxy-4-methyl-2-pentanone, acetyl acetone, ethyl acetoacetate, and the like.

Specific examples of chelating agents include quinone molecules, such as alizarin, quinizarin, amide polymers, and molecules, such as lactamide, oxamide, succinamide, or mixtures thereof, of the following representative formulas/structures

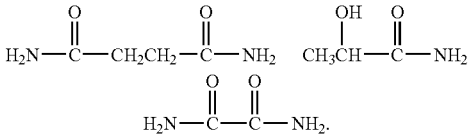

The β-hydroxyketones or β-diketones can be polymeric or small molecules. Examples of the small molecules are β-hydroxyketones or β-diketones such as 4-hydroxy-4-methyl-2-pentanone, acetyl acetone and ethyl acetoacetate, respectively,

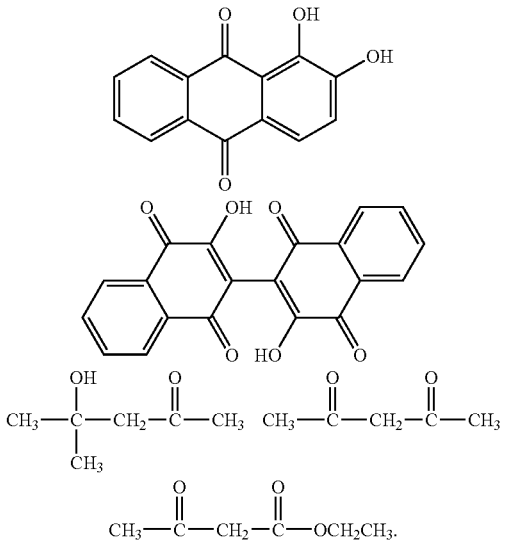

The ratio of the chelating agent to said metal oxide is from about 0.01 percent to 20 percent in weight, and more specifically, from about 0.1 to about 10 weight percent. In embodiments, the active layer further contains a polymer binder, and wherein the ratio of the photogenerating pigment to the metal oxide to the polymer to the chelating agent is from about 2/10/30/0.01 to about 5/40/50/5; wherein the active layer further contains a polymer binder, and wherein the ratio of the photogenerating pigment to the metal oxide to the polymer to the chelating agent to the charge transport component is from about 2/10/48/0.1/45 to about 5/40/40/5/10; wherein the ratio of the of the photogenerating pigment to the metal oxide to the chelating agent to the charge transport component is from about 2/10/0.1/45 to about 5/40/5/10. The chelating agent is in embodiments attached to the surface of the metal oxide as indicated, for example, by an absorption spectra change of the chelating agent.

Metal oxide examples include suitable metal oxides, such as know oxides of titanium, and more specifically, metal oxide examples are ZnO, $SnO_2$, $TiO_2$, $Al_2O_3$, $SiO_2$, $ZrO_2$, $In_2O_3$, $MoO_3$, and complex oxides of the above-mentioned metals thereof. The metal oxide in embodiments has, for example, a powder volume resistivity varying from about $10^4$ to about $10^{10}$ Ωcm at a 100 kilogram/$cm^2$ loading pressure, 50 percent humidity, and at room temperature. Also, the metal oxide like $TiO_2$ can be either surface treated or used untreated. Surface treatments include, but are not limited to, aluminum laurate, alumina, zirconia, silica, silane, methicone, dimethicone, sodium metaphosphate, and mixtures thereof. The amount of the metal oxide present in embodiments is, for example, from about 0.1 percent to about 80 percent in weight, and more specifically, from about 1 to about 40 weight percent.

Examples of $TiO_2$ include PT-401 M, available from Ishihara Sangyo Laisha, Ltd.; STR-60N™ (no surface treatment and powder volume resistivity of approximately $9\times10^5$ Ωcm) (available from Sakai Chemical Industry Co., Ltd.), FTL-100™ (no surface treatment and powder volume resistivity of approximately $3\times10^5$ Ωcm) (available from Ishihara Sangyo Laisha, Ltd.), STR-60™ ($Al_2O_3$ coated and powder volume resistivity of approximately $4\times10^6$ Ωm) (available from Sakai Chemical Industry Co., Ltd.), TTO-55N™ (no surface treatment and powder volume resistivity of approximately $5\times10^5$ Ωm) (available from Ishihara Sangyo Laisha, Ltd.), TTO-55A™ ($Al_2O_3$ coated and powder volume resistivity of approximately $4\times10^7$ Ωcm) (available from Ishihara Sangyo Laisha, Ltd.), MT-150W™ (sodium metaphosphated coated and powder volume resistivity of approximately $4\times10^4$ Ωm) (available from Tayca), and MT-150AW™ (no surface treatment and powder volume resistivity of approximately $1\times10^5$ Ωcm) (available from Tayca).

The thickness of the substrate layer depends on many factors, including economical considerations, electrical characteristics, and the like, thus this layer may be of substantial thickness, for example over 3,000 microns, such as from about 300 to about 700 microns, or of a minimum thickness. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of substantial thickness of, for example, up to many centimeters or of a minimum thickness of less than a millimeter. Similarly, a flexible belt may be of a substantial thickness of, for example, about 250 micrometers, or of minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating component in embodiments is comprised of a number of known photogenerating pigments, such as for example, about 50 weight percent of Type V hydroxygallium phthalocyanine or chlorogallium phthalocyanine, and about 50 weight percent of a resin binder like poly(vinyl chloride-co-vinyl acetate) copolymer, such as VMCH (available from Dow Chemical). Generally, the photogenerating pigments or pigments are, for example, metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder, or alternatively, no resin binder need be present. The binder resin is present in various suitable amounts, for example from about 1 to about 50 weight percent, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. The photogenerating pigment may also comprise amorphous films of selenium and alloys of selenium and arsenic, tellurium, germanium and the like; hydrogenated amorphous silicon; and compounds of silicon and germanium, carbon, oxygen, nitrogen, and the like; inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder.

In embodiments, examples of polymeric binder materials that can be selected as the matrix for active layer components are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers. Specific examples of polymer binder materials of value are polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 percent to about 50 percent of this material.

The photogenerating pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. The optional hole blocking layer may be applied to the substrate.

Charge transport components and molecules present in the single layer include a number of known materials, such as aryl amines, and more specifically, molecules of the following formula

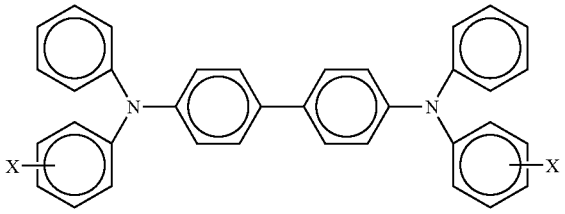

wherein X is alkyl, alkoxy, aryl, a halogen, or mixtures thereof, and especially those substituents selected from the group consisting of Cl and $CH_3$; and molecules of the following formula

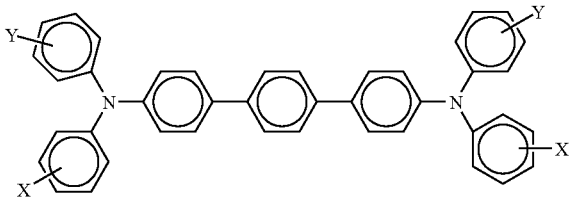

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport molecules can be selected, reference for example, U.S. Pat. Nos. 4,921,773 and 4,464,450, the disclosures of which are totally incorporated herein by reference.

Examples of charge transporting molecules, especially when there is selected a polymer or resin binder include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane.

Examples of components or materials optionally incorporated into the single layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant is from about 0 to about 20, from about 1 to about 10, or from about 3 to about 8 weight percent.

The following Examples are provided.

Comparative Example 1

A pigment dispersion was prepared by the milling of 1.3 kilograms of chlorogallium phthalocyanine (ClGaPC) pigment particles, and 867 grams of a vinylchloride and vinyl acetate copolymer (VMCH), available from Union Carbide, in 10.67 kilograms of N-butylacetate and 5.3 kilograms of xylene with 45 kilograms of 1 millimeter diameter zirconium oxide balls for from about 36 to about 72 hours. The resulting milled sample was then filtered with a 20 micrometer pore size Nylon filter and 15.3 kilograms of the dispersion were extracted. Then the resulting charge generation dispersion was further diluted with an additional solvent of 12.9 kilograms of xylene and 5.5 kilograms of butylacetate. Separately, a charge transport layer solution was prepared by mixing 5.5 grams of poly(4,4'-diphenyl-1,1'-cyclohexane carbonate), obtained from Mitsubishi Chemicals, with 4.4 grams of N,N'-diphenyl-N,N'-bis(methylphenyl)-1,1-biphenyl-4,4'-diamine, and 31.2 grams of tetrahydrofuran and 7.8 grams of toluene. This mixture was rolled in a glass bottle until the solids were dissolved.

A single layered photoconductor was prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms.

An active combined single photoconductive/charge transport layer was then prepared and deposited on the above substrate/hole blocking layer, and which layer contained a photogenerating pigment, a charge transport compound, and a resin binder generated as follows:

The photogenerating pigment dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. The resulting dispersion was then mixed with a charge transport compound generated by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids.

Thereafter, the above formed mixture was applied to the substrate/hole blocking layer with a Bird applicator to form the active layer having a thickness of 31 microns. A strip about 10 millimeters wide along one edge of the substrate bearing the blocking layer was deliberately left uncoated to facilitate adequate electrical contact by the ground strip layer that was applied later.

Example I

A photoconductor was prepared by repeating the process of Comparative Example 1 except that the active negatively charged single layer was prepared as follows.

3.3 Grams of PT-401 M $TiO_2$ and about 0.07 gram of 1,2,3,4-tetrafluoro-5,8-dihydroxyanthraquinone were mixed in 46.8 grams of THF/toluene at 70/30 weight ratio for about 2 hours. The color of the mixture changed from dark yellow to dark red, an indication that the quinone was attached to the $TiO_2$ surface. Then, 6.34 grams of poly(4,4'-diphenyl-1,1'-cyclohexane carbonate) cyclohexyl polycarbonate ($M_w$. 30,000 to 80,000) IUPILON™ Z-500, a known polycarbonate, or POLYCARBONATE Z™ (PCZ500), and 130 grams of 0.4 to 0.6 millimeter $ZrO_2/SiO_2$ beads were added, and the mixture was milled for 6 hours at 130 rpm. Subsequently, 0.26 gram of chlorogallium phthalocyanine (ClGaPC) was added and milling was continued overnight, about 18 to about 21 hours, at about 80 rpm. The weight ratio among the materials is ClGaPC/$TiO_2$/PCZ500/TFQ=2/25/48/0.5. The dispersion was then filtered with 40 μm Nylon cloth, and 3.3 grams of N,N'-bis(methylphenyl)-1,1-biphenyl-4,4'-diamine were added to the filtrate and dissolved followed by coating on the substrate/hole blocking layer. The thickness of the resulting single layered photoconductor was about 32 μm as measured by an Eddy current thickness gauge.

Comparative Example 2

A photoconductor was prepared by repeating the process of Comparative Example 1 except that the active single layer was prepared as follows.

3.3 Grams of PT-401 M $TiO_2$ were mixed with 46.8 grams of THF/toluene at 70/30 weight ratio for about 2 hours. Then 6.34 grams of poly(4,4'-diphenyl-1,1'-cyclohexane carbonate) cyclohexyl ($M_w$: 30,000 to 80,000) IUPILON™ Z-500, a known polycarbonate or POLYCARBONATE Z™, weight average molecular weight of 50,000, available from Mitsubishi Gas Chemical Corporation, and 130 grams of 0.4 to 0.6 millimeter $ZrO_2/SiO_2$ beads were added, and the mixture was milled for 6 hours at 130 rpm. Subsequently, 0.26 gram of chlorogallium phthalocyanine was added and milling was continued overnight, about 18 to about 21 hours, at about 80 rpm. The weight ratio among the materials was ClGaPC/$TiO_2$/PCZ500=2/25/48. The dispersion was then filtered with 40 μm Nylon cloth and 3.3 grams of N,N'-bis(methylphenyl)-1,1-biphenyl-4,4'-diamine were added to the filtrate, and dissolved followed by coating on the substrate/hole blocking layer. The thickness of the single layer imaging member was about 35 μm measured by an Eddy current thickness gauge.

Comparative Example 3

A photoconductor was prepared by repeating the process of Comparative Example 1 except that the active single layer was prepared using an electronic transport molecule instead of $TiO_2$, and without the presence of a chelating agent as follows.

3.3 Grams of carboxylfluorenone malonitrile (BCFM), a known electron transport molecule, were mixed in 46.8 grams of THF/toluene at 70/30 weight ratio for about 2 hours. Then, 6.34 grams of poly(4,4'-diphenyl-1,1'-cyclohexane carbonate) IUPILON™ Z-500, a known polycarbonate or POLYCARBONATE Z™, weight average molecular weight of 50,000, available from Mitsubishi Gas Chemical Corporation, 0.26 gram of chlorogallium phthalocyanine, and 130 grams of 0.4 to 0.6 millimeter $ZrO_2/SiO_2$ beads were added to the resulting mixture followed by milling for 18 hours at 80 rpm. The weight ratio among the materials was ClGaPC/BCFM/PCZ500=2/25/48. The dispersion was then filtered with 40 μm Nylon cloth and 3.3 grams of N,N'-bis(methylphenyl)-1,1-biphenyl-4,4'-diamine was added to the filtrate and dissolved followed by coating on the substrate/hole the blocking layer of the above Comparative Example 2. The thickness of the single layer photoconductor was about 28 μm as measured by an Eddy current thickness gauge.

Electrical Property Testing

The above prepared four photoreceptor devices were tested in a scanner set to obtain negatively charged photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant negative voltage charging at various surface potentials.

In embodiments as compared to the Comparative Example 2 photoconductor, a number of improved characteristics for the above Example I photoconductive member as determined by the generation of known negative charging PIDC curves, and more specifically improved charge acceptance, as indicated from a higher surface potential voltage at the same level of charging for the Example I photoconductor than the Comparative Example 2 photoconductor. The physical thickness of the above Example I 2 percent TFQ doped single layer photoconductor was about 34 microns, while the Comparative Example 2 photoconductor was about 35 microns thick as measured by permascope. Without the TFQ doping, the Comparative Example 1 photoconductor could only be charged to about 300 volts even as the Vscreen of the scorotron was set at close to 800 volts. In contrast, $V_{high}$ of about 635 volts was achieved for the single layer photoconductors with 2 percent TFQ doping.

The photosensitivity for the Example I TFQ doped $TiO_2$/ClGaPC single layer device was about 455 $Vcm^2$/ergs at negative charging, more than twice the amount of the Comparative Examples 1 and 2, which was measured as 205 $Vcm^2$/ergs. While not being desired to be limited by theory, it is believed that the high sensitivity to photoinduced dark decay for the photoconductor of Example I results from the sensitization effects of $TiO_2$ to the ClGaPC photogenerating pigment, and the use of the TFQ chelating agent.

The photoconductor of Example I had a negatively charged photosensitivity of 455 $Vcm^2$/ergs, thus permitting, for example, developed electrostatic images with excellent resolutions and substantially no undesirable background deposits. In contrast, the photosensitivity of the Comparative Examples 2 and 3 photoconductors was of low values of 50 and 20 $Vcm^2$/ergs, respectively, and thus electrostatic developed images of low resolution and density were obtained.

While not being desired to be limited by theory, it is believed that the high sensitivity to photoinduced dark decay for the photoconductor of Example I results from the sensitization effects of $TiO_2$ to the ClGaPC photogenerating pigment and the use of the TFQ chelating agent.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A single layered flexible belt imaging member comprised of a supporting substrate, and a layer in contact with said substrate, and which layer is comprised of at least one photogenerating pigment, at least one charge transport component, and a metal oxide having chelated thereto a chelating agent of a tetrafluorodihydroxy anthraquinone, and wherein the ratio of said photogenerating pigment to said metal oxide to said chelating agent to said charge transport component is from about 2/10/0.1/45 to about 5/40/5/10.

2. A photoconductor comprising a supporting substrate, and an active layer in contact with said substrate, and which layer is comprised of at least one photogenerating pigment, at least one charge transport component, and a mixture of a metal oxide and a chelating agent of a tetrafluorodihydroxy anthraquinone, wherein said chelating agent is chelated to said metal oxide, and wherein said active layer further contains a polymer binder, and wherein the ratio of said photogenerating pigment to said metal oxide to said polymer to said chelating agent is from about 2/10/30/0.01 to about 5/40/50/5, and wherein said charge transport component is present in an amount of from about 5 to about 50 weight percent.

3. A photoconductor in accordance with claim 2 wherein said chelating agent is present on the surface of said metal oxide.

4. A photoconductor in accordance with claim 2 wherein said chelating agent is

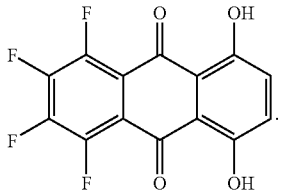

5. A photoconductor in accordance with claim 2 wherein said charge transport component is

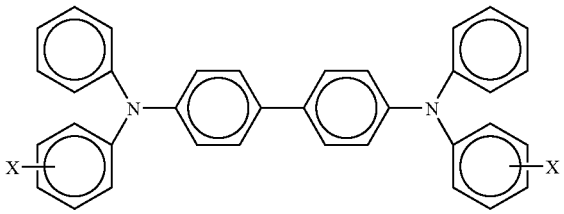

wherein X is selected from the group comprised of alkyl, alkoxy, aryl, and halogen.

6. A photoconductor in accordance with claim 5 wherein said alkyl and said alkoxy each contains from about 1 to about 12 carbon atoms, and said aryl contains from about 6 to about 36 carbon atoms, and said substrate is present.

7. A photoconductor in accordance with claim 5 wherein said charge transport component is aryl amine of N,N'-diphenyl-N,N-bis(3-methylphenyl)-1,1'-biphenyl-4,4'-diamine and said substrate is present.

8. A photoconductor in accordance with claim 2 wherein said charge transport component is comprised of aryl amine molecules, and which aryl amines are of the formula

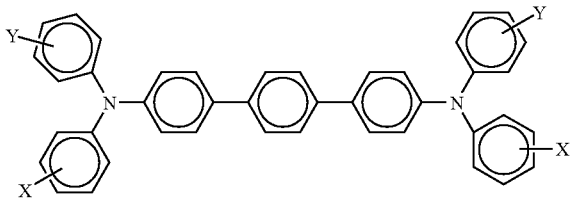

wherein X and V are independently selected from the group comprised of alkyl, alkoxy, aryl, and halogen.

9. A photoconductor in accordance with claim 8 wherein alkyl and alkoxy each contains from about 1 to about 12 carbon atoms, and aryl contains from about 6 to about 36 carbon atoms, and said substrate is present.

10. A photoconductor in accordance with claim 2 wherein said charge transport component is an aryl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures thereof.

11. A photoconductor in accordance with claim 2 wherein the ratio of said photogenerating pigment to said metal oxide to said polymer to said chelating agent to said charge transport component is from about 2/10/48/0.1/45 to about 5/40/40/5/10.

12. A photoconductor in accordance with claim 2 wherein said photogenerating pigment is comprised of at least one of a metal phthalocyanine, a metal free phthalocyanine, a titanyl phthalocyanine, a halogallium phthalocyanine, a perylene, or mixtures thereof.

13. A photoconductor in accordance with claim 2 wherein said photogenerating pigment is comprised of a titanyl phthalocyanine.

14. A photoconductor in accordance with claim 2 wherein said photogenerating pigment is comprised of chlorogallium phthalocyanine.

15. A photoconductor in accordance with claim 2 wherein said photogenerating pigment is comprised of hydroxygallium phthalocyanine.

16. A photoconductor in accordance with claim 2 wherein said active layer further includes antioxidant of at least one of a hindered phenolic and a hindered amine.

17. A photoconductor in accordance with claim 2 further including a hole blocking layer, and an adhesive layer.

18. A negatively charging single layer photoconductor comprised of at least one photogenerating pigment, at least one charge transport component, at least one polymer binder, and a mixture of a metal oxide and a chelating agent of an anthraquinone, wherein said chelating agent is chelated to said metal oxide, the ratio of said photogenerating pigment to said metal oxide to said chelating agent to said charge transport component is from about 2/10/0.1/45 to about 5/40/5/10; and wherein said chelating agent is

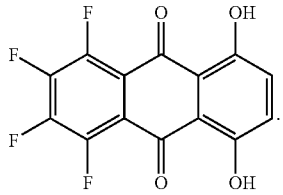

19. A photoconductor in accordance with claim 18 wherein said chelating agent is 1,2,3,4-tetrafluoro-5,8-dihydroxyanthraquinone.

20. A photoconductor in accordance with claim 18 wherein said metal oxide is at least one of ZnO, $SnO_2$, $TiO_2$, $Al_2O_3$, $SiO_2$, $ZrO_2$, $In_2O_3$, and $MoO_3$.

21. A photoconductor in accordance with claim 18 wherein said metal oxide is titanium dioxide.

22. A photoconductor in accordance with claim 2 wherein said metal oxide is at least one of ZnO, $SnO_2$, $TiO_2$, $Al_2O_3$, $SiO_2$, $ZrO_2$, $In_2O_3$, and $MoO_3$.

23. A photoconductor in accordance with claim 2 wherein said metal oxide is $TiO_2$.

24. A photoconductor in accordance with claim 2 further containing in said layer a polymer binder.

25. A photoconductor in accordance with claim 2 further containing in said layer a polycarbonate.

26. A photoconductor in accordance with claim 2 wherein the substrate is comprised of a conductive material.

27. A photoconductor in accordance with claim 2 wherein the substrate is comprised of aluminum.

28. A photoconductor in accordance with claim 2 wherein the substrate is comprised of a polymer.

29. A photoconductor in accordance with claim 2 wherein said chelating agent is 1,2,3,4-tetrafluoro-5,8-dihydroxyanthraquinone.

* * * * *